US008884784B2

(12) United States Patent
Kirsch

(10) Patent No.: US 8,884,784 B2
(45) Date of Patent: Nov. 11, 2014

(54) SOLAR CHARGED AUTOMOTIVE VEHICLE HAVING MEANS TO DETERMINE A PARKING LOCATION

(75) Inventor: David M. Kirsch, Torrance, CA (US)

(73) Assignee: Honda Motor Co., Ltd., Tokyo (JP)

( * ) Notice: Subject to any disclaimer, the term of this patent is extended or adjusted under 35 U.S.C. 154(b) by 274 days.

(21) Appl. No.: 13/459,857

(22) Filed: Apr. 30, 2012

(65) Prior Publication Data

US 2013/0285841 A1 Oct. 31, 2013

(51) Int. Cl.
*G08B 21/00* (2006.01)

(52) U.S. Cl.
USPC ..... 340/932.2; 701/439

(58) Field of Classification Search
CPC ..... G08G 1/14; G08G 1/143; Y04S 30/12; Y02T 90/168
USPC ..... 340/932.2, 636.1, 438; 701/532, 439
See application file for complete search history.

(56) References Cited

U.S. PATENT DOCUMENTS

| | | | | |
|---|---|---|---|---|
| 3,763,484 | A * | 10/1973 | Byers | 340/669 |
| 2009/0288890 | A1 | 11/2009 | Freeman | |
| 2010/0042318 | A1 * | 2/2010 | Kaplan et al. | 701/204 |
| 2010/0169008 | A1 | 7/2010 | Niwa et al. | |

FOREIGN PATENT DOCUMENTS

| | | |
|---|---|---|
| JP | 2000-353295 | 12/2000 |

* cited by examiner

*Primary Examiner* — Jeffery Hofsass
(74) *Attorney, Agent, or Firm* — Fay Sharpe LLP

(57) ABSTRACT

An automotive vehicle having at least one solar panel, a battery rechargeable by the at least one solar panel, and a computer system including one or more processors and memory storing one or more programs. The program(s) generate a list of parking locations, determine which of the one or more parking location provide sun exposure, and recommending at least one parking location to a vehicle operator.

20 Claims, 3 Drawing Sheets

SOLAR CHARGED AUTOMOTIVE VEHICLE HAVING MEANS TO DETERMINE A PARKING LOCATION

BACKGROUND

The present exemplary embodiment relates to solar charging protocols for electric or hybrid vehicles. However, it is to be appreciated that the present exemplary embodiment is also amenable to other similar applications.

Electric vehicles are powered by an electric motor to which electricity is provided by a group of batteries. Operation of the motor depletes energy stored in the batteries. Electric vehicles are typically recharged from an external power source. For example, the electric vehicle can be recharged at a home or office location by being plugged into a standard outlet. Also, commercial fast charging stations are becoming more commonly available where a higher current charge can be delivered.

A hybrid vehicle operates using both hydrocarbon fuel and electric power. A conventional engine is fueled by the hydrocarbon fuel while an electric motor is powered by a battery. The engine may operate a generator which charges the battery at times when the full power of the engine is not needed to propel the vehicle. A plug-in hybrid is a hybrid vehicle in which the driver has the option of plugging the vehicle into an exterior electric power source when it is parked so that the battery does not have to be charged by the engine.

Solar vehicles, as referred to herein, include electric and hybrid vehicles which have one or more solar panels on the body to provide part of the electricity for the electric motor and/or for charging the batteries and further to any vehicle including one or more solar panels that provide electrical power to a vehicle accessory, such as a radio or the vehicle's heating, ventilating and air conditioning system.

An exemplary electric vehicle including solar panels is depicted in FIG. 1. Vehicle 10 includes storage batteries 12 mounted within the vehicle. A plurality of solar panels 14 are located on the hood and roof to convert incident solar radiation into electrical energy. The solar panels 14 are electrically connected to the storage batteries 12 and are operative to supply electrical current thereto for recharging. In general, the panels are preferably as large as practical to help create a large total area of solar panels. In practice, this may mean that parts of the panels extend over air rather than the vehicle body.

Furthermore, notwithstanding the reference to solar panels, other types of systems devised to convert solar radiation into electricity may be suitable for use in the presently disclosed embodiment. Moreover, the present disclosure is suited to any type of apparatus attached to a vehicle that generates electrical energy from solar radiation. Accordingly, the use of the phrase "solar panel" throughout this disclosure is intended to encompass all such apparatus.

A typical car belonging to an individual is parked most of the time. Therefore, if significant sun exposure can be provided while parked, solar charging can provide a substantial portion of the required energy. In the case of an electric vehicle, the solar vehicle would likely also be a plug-in, so if sunlight is unavailable for any reason (weather, parked underground etc.) the battery can be charged from grid power. In the case of a hybrid vehicle, the battery of the solar hybrid can be charged by the solar panels and by the engine and perhaps also as a plug-in.

As compared to a solely plug in electric car, a key advantage of a solar vehicle is that it can be more easily charged at a location away from the operator's home. By utilizing an integrated vehicle controller and GPS system, and/or a smart phone, it is possible to provide guidance to the vehicle operator to maximize vehicle charging via solar energy.

BRIEF DESCRIPTION

Various details of the present disclosure are hereinafter summarized to provide a basic understanding. This summary is not an extensive overview of the disclosure and is intended neither to identify certain elements of the disclosure, nor to delineate the scope thereof. Rather, the primary purpose of the summary is to present certain concepts of the disclosure in a simplified form prior to the more detailed description that is presented hereinafter.

According to a first embodiment, an automotive vehicle having at least one solar panel and a battery rechargeable by the solar panel is provided. A computer system including one or more processors and memory storing one or more programs is also provided. The programs function to identify parking location(s) and determine at least one parking location that provides sun exposure.

According to a further embodiment, a method for directing the parking of an automotive vehicle including at least one solar panel and a battery rechargeable by the at least one solar panel is provided. The method comprises selecting a parking location and identifying geographically proximate parking facilities having surface or roof top parking spaces. The identified parking facilities are assessed based upon at least one of weather, time of day and date, and shading and a recommended parking facility is provided to a vehicle operator.

According to an alternative embodiment, a navigation device for an automotive vehicle is provided. The navigation device comprises a display unit for displaying information, a positioning unit for determining a location of the vehicle and an information database retaining or accessing the geographical position of parking facilities. A processor interfaces with the positioning unit and the information database to calculate the sun exposure of the parking facilities. The processor further interfaces with the display unit to communicate which parking facilities have sun exposure to a vehicle operator.

DETAILED DESCRIPTION

Electric and hybrid vehicles require significant automated control to provide efficient and reliable performance. A controller is therefore necessarily provided. The controller may be a computer formed of one or more processors associated with the vehicle. In a hybrid vehicle, the controller runs an optimized control algorithm that determines on a moment-to-moment basis when to use either the engine, the motor or both; in what ratio, and also when to charge the battery from the engine. In pure electric vehicles, the controller makes decisions about how and when to recharge the battery.

Remote communication to and from vehicles has been known for many years. For example, satellite technology (e.g. GPS) can be used to send information regarding location, mapping, and guidance. Vehicular based systems can also rely on cellular communication networks to communicate between the vehicle and a remote database or the internet. Each of these systems allows the controller to communicate with a remote device and/or the internet to provide cloud computing wherein computation and data access are feasible. Many vehicles also have internal local area wireless networks, to allow cell phones to be used in a hands free mode by the vehicle operator.

With respect to solar vehicles, a challenge for the vehicle operator is to find the best location to park the vehicle. More particularly, the challenge is to identify a parking location that provides exposure to solar radiation, and preferably, that provides the best exposure to solar radiation relative to other options, and more preferably, that provides the best solar radiation exposure over the duration the vehicle will be parked. The presently disclosed methodology advises a vehicle operator regarding how good a parking location is from a solar charging perspective and can advise the vehicle operator what an estimated charge should be based on the anticipated period of time the vehicle will be parked.

The subject methodology uses environmental characteristics, both macro and micro, to determine optimal charging locations. Advantageously, the methodology can use the existing vehicle apparatus to receive inputting of the vehicle operator's intended destination and access information concerning weather at the particular location, surface or rooftop parking availability at parking facilities, and sun blocking buildings and/or foliage adjacent the parking facilities, to name just a few data points used to recommend desirable parking location(s) for a solar vehicle.

Figure 1:
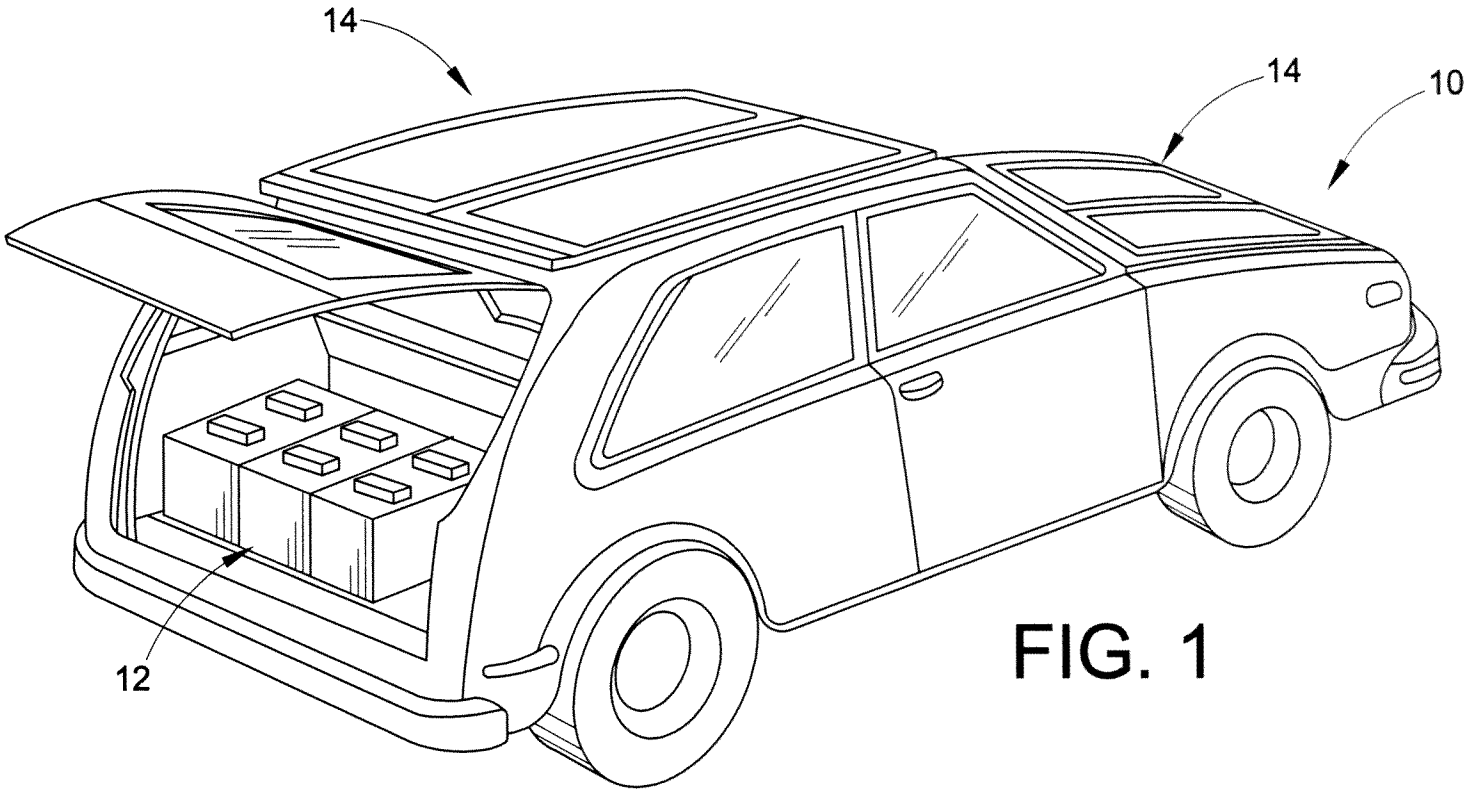
FIG. 1 is an automotive vehicle including solar panels.
Figure 2:
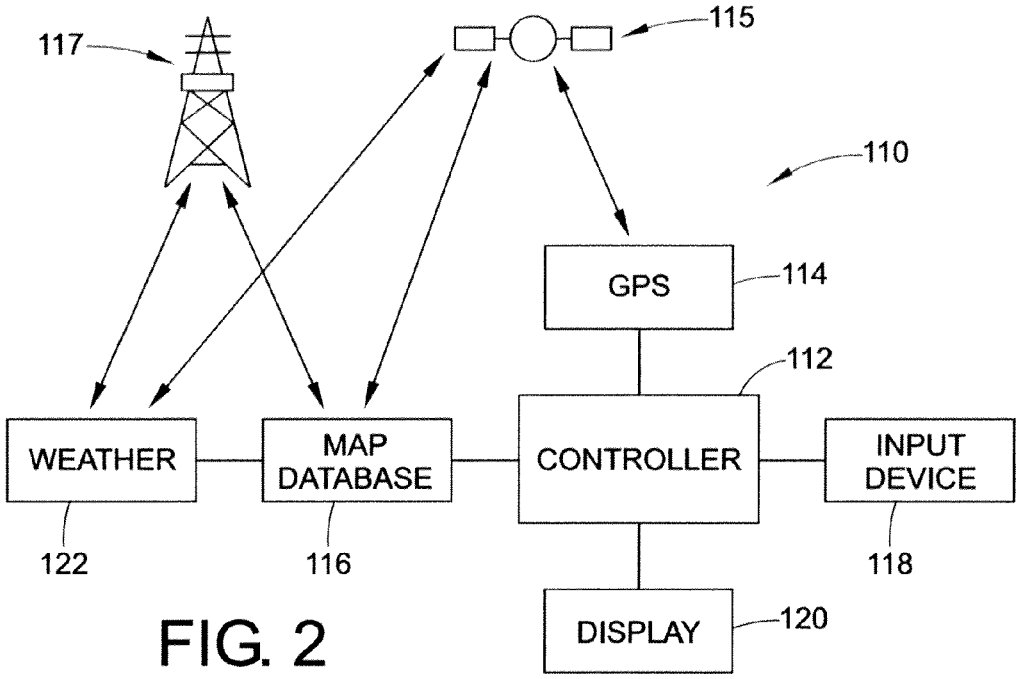
FIG. 2 is a schematic representation of a GPS guided solar charging methodology.

With reference to FIG. 2, a first embodiment of vehicle solar charging methodology 110 is depicted. Controller 112 can comprise a computer. Controller 112 is in communication with a global positioning system (GPS) 114. GPS 114 receives an electric wave from a GPS satellite 115, and detects the vehicle position in an absolute position (latitude, longitude). GPS 114 can also be utilized to identify the intended destination for the vehicle. Detected position data and intended destination data are supplied to controller 112. Instead of GPS, a self-vehicle position could also be utilized by combining distance sensors and an azimuth sensor. Moreover, the present embodiment is not limited to a particular technique for vehicle positioning.

Controller 112 is further in communication with a map database 116. Map database 116 can be a preloaded database or a device which accesses a map database stored remotely via data transmission satellite 115, cellular network 117, or other means. Map database 116 provides information regarding the location of parking facilities and their surrounding conditions.

Input device 118 is provided to allow the vehicle operator to input a desired destination for the vehicle journey which is communicated to the controller 112. The input device 118 can comprise a manual button, a touch screen or any other available interface mechanism. The controller 112 identifies parking facilities near the desired destination based upon information retrieved from the GPS 114 and the map database 116. More particularly, once a vehicle operator inputs the destination into the input device 118, controller 112 retrieves data from the GPS 114 and map database 116, identifies parking facilities near the destination, and determines which parking facilities provide surface and/or roof top parking spots wherein solar radiation may be received, hereinafter "suitable parking facilities".

The controller 112 will then determine a subset of preferred parking locations from the set of suitable parking facilities based upon a variety of factors. Several conditions directly impact the charging rate of batteries when charged by solar panels when the vehicle is parked. These factors can be initially measured and then predicted for their impact on the charging performance for an anticipated timeframe of parking. Factors that affect charging include vehicle orientation, weather, time of day, date, tilt angle of vehicle (front to back and side to side), and shading of the vehicle (structures or foliage). The methodology can use internal sensors and external information, paired with algorithms, to identify preferred parking location(s) that are optimal for vehicle charging. It is able to cross reference the environmental location with practical locations and guide the user to the best parking configuration.

For example, upon identification of suitable parking facilities, weather information in the vicinity of the destination can be acquired via a weather information receiver 122. If it is determined that the area of a destination is experiencing and expected to experience clear weather, the methodology can proceed. If, however, the weather is overcast or anticipated to become overcast, analysis of an expanded region surround the destination can be performed to identify available options with clearer weather and solar radiation exposure. Similarly, if no acceptable parking facility can be identified, a recommendation to select a parking facility with a plug-in option can be displayed.

Weather information retrieval may also be a feature performed by map database 116. Similarly, map database 116 can reside on the GPS 114. In fact, it is noted that the functions necessary to support the methodology 110 can be performed by any arrangement of the components, GPS, weather, map database, controller, input device and display such as in an integrated single unit or any combination of distinct units.

Data retrieved from map database 116 will further be used by controller 112 to calculate obstacles. More particularly, map database 116 will provide data concerning buildings and/or foliage in the vicinity of the suitable parking facilities. Using time of day and date information, controller 112 can calculate solar altitude and azimuth and predict the amount and duration of shading the buildings and/or foliage will have on the suitable parking facilities. For example, when a skyscraper exists having physical relevance to a suitable parking facility, the solar altitude and solar azimuth can be used to determine whether sunlight is radiated on the suitable parking facilities or if a shadow of the skyscraper is promulgated on the parking surface. Preferred parking facilities having the relatively lowest shaded areas and/or the relatively lowest period of shaded time can be communicated to the vehicle operator on display device 120.

The process can also direct the vehicle operator to an optimal parking space (or several optimal parking spaces from which he picks). A simple example is to guide the user to the top floor of the parking structure identified as a preferred parking facility, and then identify particular parking spaces which orient the solar vehicle in an optimal direction. For example, it may be preferable for the sun to travel from trunk to hood, or from East to West, or vice versa. By this guidance, the solar charging potential can be optimized.

It is anticipated that the methodology will also be capable of providing an estimated charging time based upon the factors identified above. Alternatively, the system will provide the anticipated level of battery charge based on the anticipated parking duration. Similarly, the methodology will be sufficiently smart such that upon entry of the anticipated parking time, the preferred parking locations will be evaluated for the previously identified factors (such as weather and shadowing) over the course of the anticipated parking time. For example, if it is anticipated that parking will occur between 8 am and 5 pm (9 hours) the vehicle operator may be guided to a parking spot providing optimal afternoon sun exposure because morning cloud cover is anticipated to clear in the afternoon. Similarly, a parking spot may be suggested having shading from an adjacent building or foliage at the time the vehicle is actually parked, but based on the sun's altitude and azimuth, will provide superior sun exposure as the day progresses.

In addition, it is anticipated that particularly with respect to an electric vehicle, the methodology will advise the vehicle operator whether or not a sufficient charge is expected to be achieved to complete travel home (or another selected destination) at the end of the parking duration.

The methodology of the present disclosure can further be utilized to recommend cost effective parking options. For example, it is feasible to identify whether within the set of preferred parking locations, a relevant parking facility is a public (free) or private (pay) facility. A recommended parking facility can then be selected based on the predicted solar charging capabilities and the requirements of the vehicle calculated for each of the two facilities. For example, if it is determined that a free parking facility will provide sufficient, albeit less, solar radiation over the anticipated parking term but will still achieve a satisfactory or full battery charge, the free parking facility can be prioritized ahead of the pay facility.

Similarly, a comparison of cost to charge can be calculated upon determination of the relative parking fees associated with the parking facility. This information can be determined via internet communications and/or via a near field communication from the parking facilities equipped with transmission devices. In addition, available parking spots can be identified by the parking facilities to facilitate an analysis of a particular high sun exposure parking spot. Furthermore, it is desirable that the vehicle operator can have the capability of reserving a spot within a parking facility via the internet or a near field communication.

Figure 3:
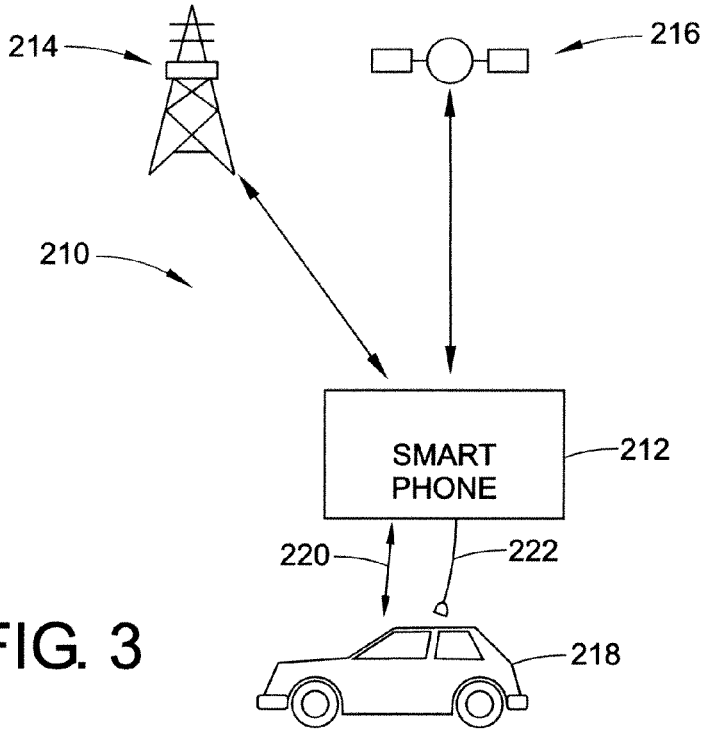
FIG. 3 is a schematic representation of a smart phone guided solar charging methodology.

With reference to FIG. 3, a similar methodology 210 is disclosed wherein, as opposed to an integral apparatus within the solar vehicle, a smart phone 212 is utilized to provide either cellular 214 or satellite 216 interconnectivity with the internet to facilitate cloud computing. As utilized herein, a smart phone is intended to encompass mobile devices including an operating system compatible with Windows, MacOS, Linux or similar systems developed in the future. In this manner, the smart phone 212 can access information such as vehicle location, weather and/or a map database. Of course the map database can be maintained on the smart phone 212. GPS can also be maintained on the smart phone 212 or could be an integral feature of the solar vehicle 218 accessible to the smart phone via a local wireless network 220. Smart phone 212 can also be physically connected to the solar vehicle 218 via a UCB connection 222, for example. In short, the methodology can be performed using a smartphone operating cooperatively with solar vehicle devices (e.g. GPS) and/or with hosted applications and/or with data retrieval from a remote site and/or the internet via satellite or cellular communication networks.

Depending on the area and time, there are optimal vehicle bearings, and optimal tilt of vehicle for orientation relative to the solar radiation. Accordingly, the vehicle may include "on board" sensors to assess factors such as vehicle tilt and orientation, which can be integrated with the controller to further refine an optimal parking space. In this manner, the methodology can direct the vehicle operator to park the vehicle in the optimal fashion.

Figure 4:
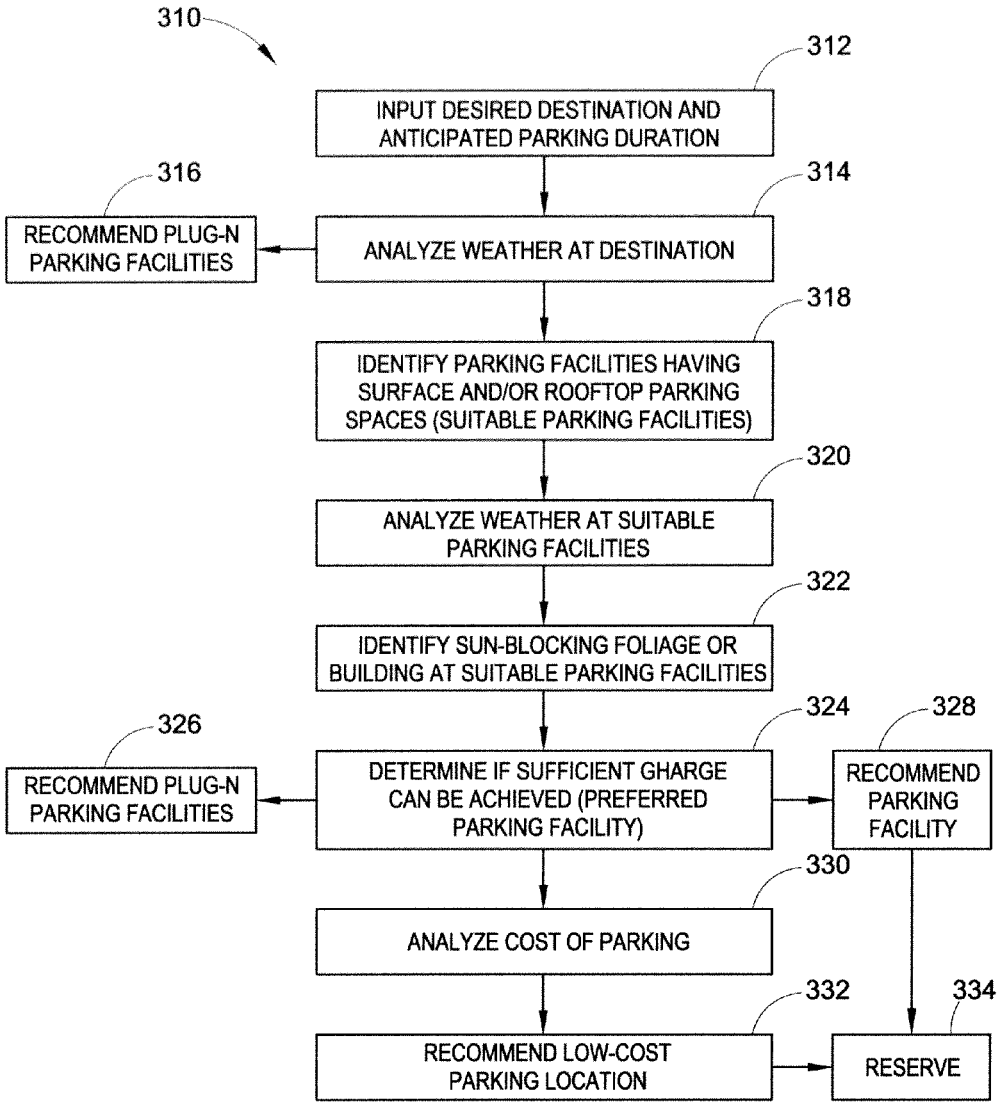
FIG. 4 is a flow chart of one embodiment of a solar charging methodology.

Turning now to FIG. 4, a flow chart of an exemplary analysis 310 of parking facilities and recommendation of preferred parking location for solar charging of an automotive vehicle is depicted. At step 312, a vehicle operator inputs a desired parking destination and an anticipated length of parking time. At step 314 analysis of weather at the desired parking location is performed, more particularly, the amount of solar radiation available at the desired parking destination is calculated. If it is determined that insufficient solar radiation will be available at the desired parking destination over the anticipated length of parking time to achieve significant charging of the vehicle, step 316 is the recommendation that the vehicle operator park at a location having plug-in availability.

If sufficient solar radiation is expected to be available to achieve substantial battery charging, the process proceeds to step 318 wherein parking facilities having rooftop and/or surface parking spots are identified such that solar radiation can be received by the automotive vehicle. These parking facilities can be categorized suitable park facilities.

At step 320, a comparison of suitable parking facilities based on anticipated weather conditions, i.e., solar radiation availability, can be performed. At step 322, an analysis of sun blocking foliage and/or adjacent buildings relative to the suitable parking facilities is performed based on solar altitude and azimuth. At step 324, based upon the data obtained in steps 320 and 322, an analysis of whether or not a sufficient charge can be achieved is performed. If a sufficient charge cannot be achieved at any of the suitable parking facilities, step 326 recommends a plug-in parking facility. At step 328, if sufficient charge can be achieved at only one of the suitable parking facilities, a recommendation to park at that preferred parking facility can be made.

If more than one preferred parking facility exists, an analysis of the cost of parking at the more than one preferred parking facility is performed in step 330 and a recommendation of the lowest cost option to achieve satisfactory charging is performed at step 332. At step 334, reserving of a suitable parking spot at a preferred parking facility can be performed.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, and the like), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising".

The invention claimed is:

1. An automotive vehicle comprising at least one solar panel, a battery rechargeable by the at least one solar panel, and a computer system including one or more processors and memory storing one or more programs, said program requesting input of an anticipated parking duration, generating a list of parking facilities, determining which one or more parking facilities provide sun exposure, and recommending at least one parking facility to a vehicle operator, said program further calculating at least one optimal parking space within said parking facility based on at least one of vehicle orientation, time of day, date, shading and vehicle tilt, and directing the vehicle operator to said at least one optimal parking space.

2. The vehicle of claim 1, wherein a database of parking locations is maintained in said memory or accessed remotely via one of satellite and cellular network communications.

3. The vehicle of claim 1, including a GPS.

4. The vehicle of claim 1, wherein one or more of said programs provides a mapping function.

5. The vehicle of claim 1, wherein one or more of said programs determines weather conditions at an anticipated parking location.

6. The vehicle of claim 1, further including at least one sensor determining vehicle tilt, said sensor in communication with said computer system to allow vehicle tilt to be assessed in determining optimal sun exposure.

7. A method for directing the parking of an automotive vehicle including at least one solar panel and a battery rechargeable by the at least one solar panel, the method comprises selecting an anticipated parking location, identifying parking facilities having surface or rooftop parking spaces geographically proximate to said parking location, assessing the identified parking facilities based on at least one of weather conditions, time of day and date, and shading and providing at least one recommended parking facility to a vehicle operator, said method further comprising assessing the parking spaces within said recommended parking facility based on at least one of weather conditions, time of day and date, and shading and recommending at least one optimal parking space to the vehicle operator.

8. The method of claim 7, wherein at least one of parking cost and anticipated duration of parking are assessed.

9. The method of claim 7, being performed by a smart phone.

10. The method of claim 7, further comprising identifying real time available parking spaces via satellite or near field communication.

11. The method of claim 7, further comprising reserving a parking space.

12. The method of claim 7, further comprising advising the vehicle operator if a sufficient battery charge will be achieved to complete travel to a subsequent destination.

13. The method of claim 7, wherein said at least one recommended parking facility comprises a plug-in facility.

14. The method of claim 7, further comprising the step of providing the vehicle operator at least one of a predicted amount of time until an at least substantially fully charged battery is achieved and a predicted level of battery charge at the end of an anticipated duration of parking.

15. The method of claim 7 further comprising predicting an anticipated duration of parking.

16. The method of claim 7 being performed by a navigation system for said automotive vehicle.

17. The method of claim 16 wherein said geographically proximate parking facilities are identified from a database stored on said navigation system or from a remote database accessed via a satellite or cellular network communication.

18. A navigation device for an associated, at least partially, solar powered vehicle comprising a display unit, a positioning unit for determining a location of said vehicle, an information database retaining or accessing a geographical position of parking locations, a control unit for calculating the sun exposure of parking spaces within the parking locations and instructing the display unit to display a parking space having optimal sun exposure.

19. The navigation device of claim 18, wherein the step of calculating the sun exposure comprises analyzing shading of the parking locations.

20. The method of claim 1, wherein said vehicle is directed to a parking space having optimal sun exposure at a point in time later in a parking period than at an initiation of the parking period.

* * * * *